US009839338B2

(12) United States Patent
Zhu et al.

(10) Patent No.: US 9,839,338 B2
(45) Date of Patent: Dec. 12, 2017

(54) MULTIFUNCTIONAL BROOM

(71) Applicant: JIAXING JACKSON TRAVEL PRODUCTS CO., LTD., Jiaxing (CN)

(72) Inventors: Xuelin Zhu, Jiaxing (CN); Jianwei Song, Jiaxing (CN)

(73) Assignee: JIAXING JACKSON TRAVEL PRODUCTS CO., LTD., Jiaxing (CN)

( * ) Notice: Subject to any disclaimer, the term of this patent is extended or adjusted under 35 U.S.C. 154(b) by 0 days.

(21) Appl. No.: 14/655,362

(22) PCT Filed: Jun. 7, 2015

(86) PCT No.: PCT/CN2015/080951
§ 371 (c)(1),
(2) Date: Jun. 25, 2015

(87) PCT Pub. No.: WO2016/037502
PCT Pub. Date: Mar. 17, 2016

(65) Prior Publication Data

US 2016/0235271 A1 Aug. 18, 2016

(30) Foreign Application Priority Data

Sep. 12, 2014 (CN) ..... 2014 2 0528143 U

(51) Int. Cl.
*A47L 13/52* (2006.01)
*A47L 13/12* (2006.01)
(Continued)

(52) U.S. Cl.
CPC ..... *A47L 13/12* (2013.01); *A46B 15/0095* (2013.01); *A46B 17/08* (2013.01);
(Continued)

(58) Field of Classification Search
CPC ..... A47L 13/10; A47L 13/42; A47L 13/48; A47L 13/52; A46B 15/00
See application file for complete search history.

(56) References Cited

U.S. PATENT DOCUMENTS 5,425,153 A * 6/1995 Vosbikian ..... A47L 13/52 15/257.2
5,661,868 A 9/1997 Panagakos et al.
(Continued)

FOREIGN PATENT DOCUMENTS

CN 201110293 9/2008
CN 201143187 11/2008
(Continued)

OTHER PUBLICATIONS

International Search Report. issued in the corresponding PCT application No. PCT/CN2015/080951, dated Sep. 10, 2015, 6 pages.

*Primary Examiner* — Shay Karls
(74) *Attorney, Agent, or Firm* — Hamre, Schumann, Mueller & Larson, P.C.

(57) ABSTRACT

The present utility model belongs to the technical field of cleaning tools and particularly relates to a multifunctional broom in order to solve the problems such as a single function of existing brooms. The multifunctional broom comprises a broom pole and a broom head disposed at one end of the broom pole, wherein a broom head housing axially movably disposed on the broom pole is provided in the periphery of the broom head, an opening for allowing the lower end of the broom head to extend from the broom head housing is formed at the lower end of the broom head housing, and a contractible positioning mechanism for enabling the broom head housing to be positioned on the broom pole, when the length of the lower end of the broom head extending from the broom head housing is adjusted to a desired length, is provided between the broom pole and the
(Continued)

broom head housing. The multifunctional broom is multiple-purpose and functions as a scraper, a brush and a broom by controlling the length of the broom head extending from the broom head housing by a contractible positioning mechanism; moreover, the dirt on the bristles is easy to clean, so the multifunctional broom is convenient to use and easy to carry and store.

2 Claims, 5 Drawing Sheets

(51) Int. Cl.

| | |
|---|---|
| ***A47L 13/10*** | (2006.01) |
| ***A47L 13/42*** | (2006.01) |
| ***A46B 15/00*** | (2006.01) |
| ***A46B 17/08*** | (2006.01) |

(52) U.S. Cl.
CPC ..... *A47L 13/10* (2013.01); *A47L 13/42* (2013.01); *A47L 13/52* (2013.01); *A46B 2200/302* (2013.01)

(56) References Cited

U.S. PATENT DOCUMENTS

| | | | | |
|---|---|---|---|---|
| 6,606,756 | B2 * | 8/2003 | Fernandez | A46B 9/10 15/106 |
| 7,171,719 | B1 * | 2/2007 | Harrelson | A47L 13/52 15/257.1 |
| 8,104,620 | B2 * | 1/2012 | Lin | A47L 13/41 15/1 |
| 8,984,702 | B2 * | 3/2015 | Pant | A46B 5/0058 15/105 |

FOREIGN PATENT DOCUMENTS

| | | |
|---|---|---|
| CN | 102038473 | 5/2011 |
| CN | 203153657 | 8/2013 |
| CN | 203789855 | 8/2014 |
| CN | 203789855 U * | 8/2014 |
| CN | 204033270 | 12/2014 |

* cited by examiner

MULTIFUNCTIONAL BROOM

TECHNICAL FIELD OF THE UTILITY MODEL

The present invention present utility model belongs to the technical field of cleaning tools and particularly relates to a multifunctional broom.

BACKGROUND OF THE UTILITY MODEL

As a common cleaning tool in daily life, a broom generally includes a broom head, bristles provided on the broom head and a broom pole provided on the broom head. When in use, the broom pole is held to allow the bristles to clean a position to be cleaned. Although the existing brooms are gradually diversified in structural design, such brooms often function as brooms only. Furthermore, as the bristles are always exposed outside the broom head, it is very inconvenient to carry and store the brooms.

To solve the problems in the prior art, undergoing long-term exploration, people have proposed various solutions. For example, Chinese Patent No. 201320067398.1 has disclosed a retractable broom, including a handle and a broom head, wherein the handle is cylindrical and provided therein with a pull rod, and the lower end of the pull rod is connected to the broom head; the broom head consists of two portions of the same shape and size, bristles on the broom head are fixed on bases, spring hinges are provided on adjacent sides of the two bases, respectively; a shaft is provided on the bottom of the pull rod, connecting rods are provided at two ends of the shaft, respectively, and the bottoms of the two connecting rods are connected with the two ends of the spring hinges, respectively. Through this solution solves the problem that it is inconvenient to carry and store the existing broom to a certain extent, there still be a problem of a single function in this solution.

SUMMARY OF THE UTILITY MODEL

In view of the above problems, the present utility model provides a multifunctional broom with simple and rational structure and multi-purpose use.

To achieve the above object, the present utility model employs the following technical solutions: a multifunctional broom is provided, including a broom pole and a broom head disposed at one end of the broom pole, wherein a broom head housing axially movably disposed on the broom pole is provided in the periphery of the broom head, an opening for allowing the lower end of the broom head to extend from the broom head housing is formed at the lower end of the broom head housing, a contractible positioning mechanism for enabling the broom head housing to be positioned on the broom pole, when the length of the lower end of the broom head extending from the broom head housing is adjusted to a desired length, is provided between the broom pole and the broom head housing. Apparently, when the broom head housing is axially moved relative to the broom pole, by controlling the length of the broom head extending from the broom head housing by the contractible positioning mechanism and allowing the broom head to be fixed relative to the broom head housing, the extension length of the brush on the broom head may be realized, so that broom has various use states.

In the multifunctional broom, the broom head includes a base and bristles provided on the base, the base being fixedly connected to the broom pole, a lower end of the brush being able to axially move upward relative to the broom pole along with the broom head housing and thus extend from the opening, the length of the lower end of the brush extending from the opening being controlled by the contractible positioning mechanism. The base, the broom pole and the brush are fixedly connected to each other, and the length of the exposed brush is controlled by axially moving the broom head housing relative to the broom pole.

In the multifunctional broom, the contractible positioning mechanism is a gear-type positioning mechanism or an infinite-adjustment positioning mechanism.

In the multifunctional broom, the contractible positioning mechanism includes a plurality of gear positioning holes that are axially distributed along the broom pole at intervals and located on a same straight line, and a switching mechanism capable of being fitted with the gear positioning holes to realize the positioning of the broom head housing on the broom pole is provided on the broom head housing. By fitting the switching mechanism with the plurality of gear positioning holes, the positioning of the broom head housing on the broom pole is realized.

In the multifunctional broom, the switching mechanism includes a button plate, a switch mounting groove and a spring, the switch mounting groove being located on an outer side of the broom head housing, the middle portion of the button plate being rotatably connected with the broom head housing, a positioning column which can be inserted into the positioning holes being provided at one end of the button plate, the spring being provided between the other end of the button plate and the broom head housing, one end of the spring acting on the button plate while the other end thereof acting on the broom head housing. When in use, the button plate drives the positioning column to be inserted into a gear positioning hole under the action of the spring so as to realize the positioning of the broom head housing on the broom pole. When one end of the button plate is pressed down to overcome the acting force of the spring, the button plate swings, and the positioning column is disconnected from the gear positioning hole so as to release the positioning.

In the multifunctional broom, the middle portion of the base is connected with a connecting column which is connected to the broom pole, the upper end of the broom head housing has a tube communicated to the inside of the broom head housing, and the connecting column and the lower end of the broom pole are penetrated into the tube. Preferably, the connecting column is in threaded connection to the broom pole, and the tube may protect the connection of the connecting column and the broom pole.

In the multifunctional broom, there are three gear positioning holes all provided on the connecting column; when the uppermost gear positioning hole is fitted with the switching mechanism, the lower end of the bristles is located in the broom head housing; when the middle gear positioning hole is fitted with the switching mechanism, a portion of the lower end of the bristles exposed from the broom head housing serves as a brush; and when the lowermost gear positioning hole is fitted with the switching mechanism, a portion of the lower end of the bristles exposed from the broom head housing functions as cleaning. In other words, the broom has three gears, i.e., upper, middle and lower gears. When the uppermost gear positioning hole is fitted with the switching mechanism, the bristles are hidden in the broom head housing, and the outer side of the end portion of the broom head housing may scrape off dirt at a position to be cleaned; when the middle gear positioning hole is fitted with the switching mechanism, a portion of the bristles is exposed, and the exposed portion may serve as a brush due to short length and high hardness; and when the lowermost gear positioning hole is fitted with the switching mechanism, a portion of the lower end of the bristles exposed from the broom head housing functions as cleaning.

In the multifunctional broom, a connecting sleeve is provided in the opening of the broom head housing, and the bristles can pass through a grate provided in the connecting sleeve. Apparently, when the broom head housing is retracted, the grate may clean dirt such as hairs on the bristles.

In the multifunctional broom, at a side portion of the lower end of broom head housing, provided is any one or a combination of a first scraper extending along a direction of the length of the opening and a second scraper extending along a direction of the width of the opening. Thus, the use effect when the bristles are hidden in the broom head housing and the broom serves as a scraper is improved.

As another preferred solution, in the multifunctional broom, the multifunctional broom further includes a bucket, the bucket including a bucket body having a shape fitted with the broom head housing and a handle provided at the upper end of the bucket body, the handle having a slot which axially extends along the handle and is able to be buckled on the broom pole, two shoulders of the bucket being provided with toothed plates, respectively. The broom herein and the bucket are used cooperatively, and the toothed plates on the bucket may clean dirt on the bristles.

Compared with the prior art, the multifunctional broom is multiple-purpose and functions as a scraper, a brush and a broom by controlling the length of the broom head extending from the broom head housing by a contractible positioning mechanism; moreover, the dirt on the bristles is easy to clean, so the multifunctional broom is convenient to use and easy to carry and store.

BRIEF DESCRIPTION OF THE DRAWINGS

FIG. 6 is an exploded view of Embodiment 2 of the present utility model; in which:

Figure 1:
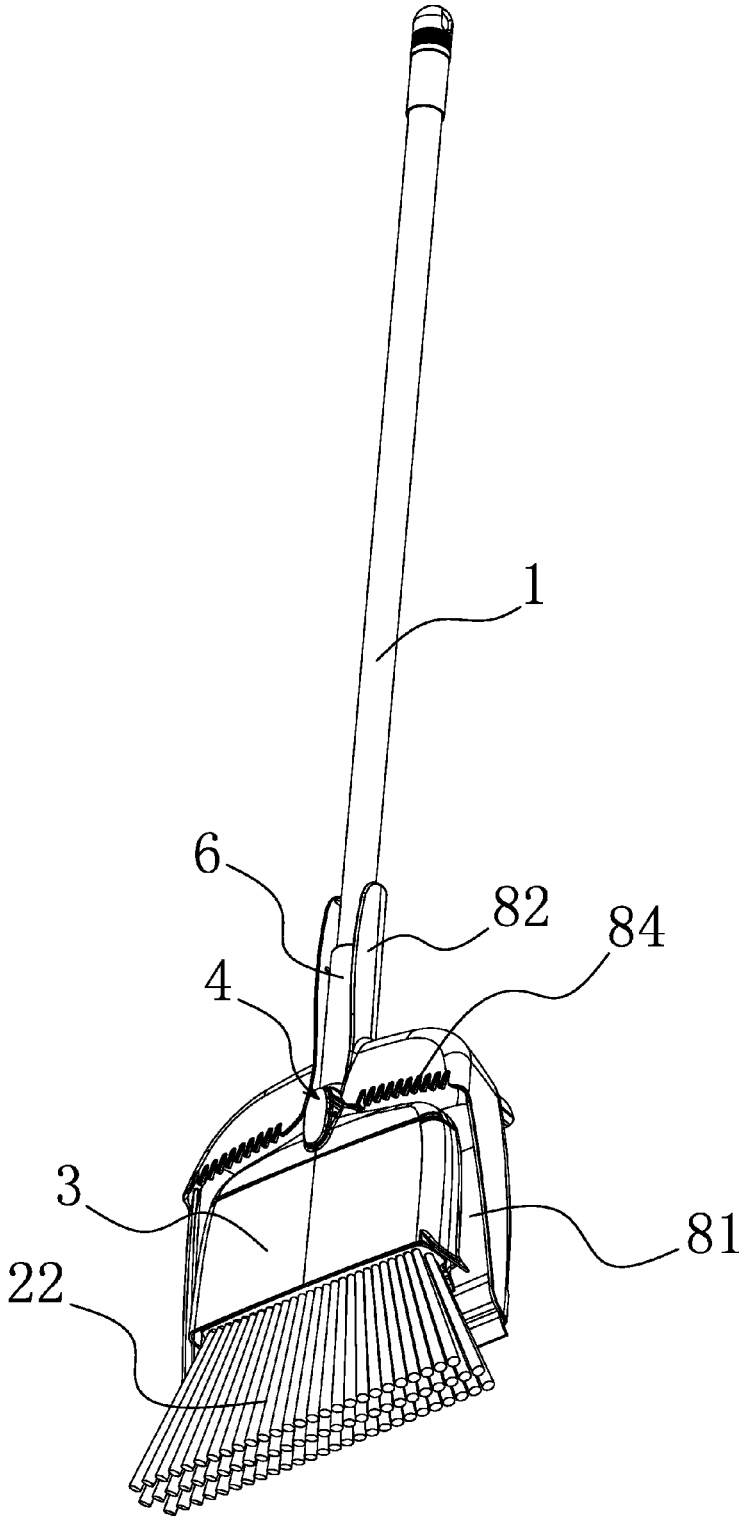
FIG. 1 is a structural diagram of Embodiment 1 of the present utility model.
Figure 2:
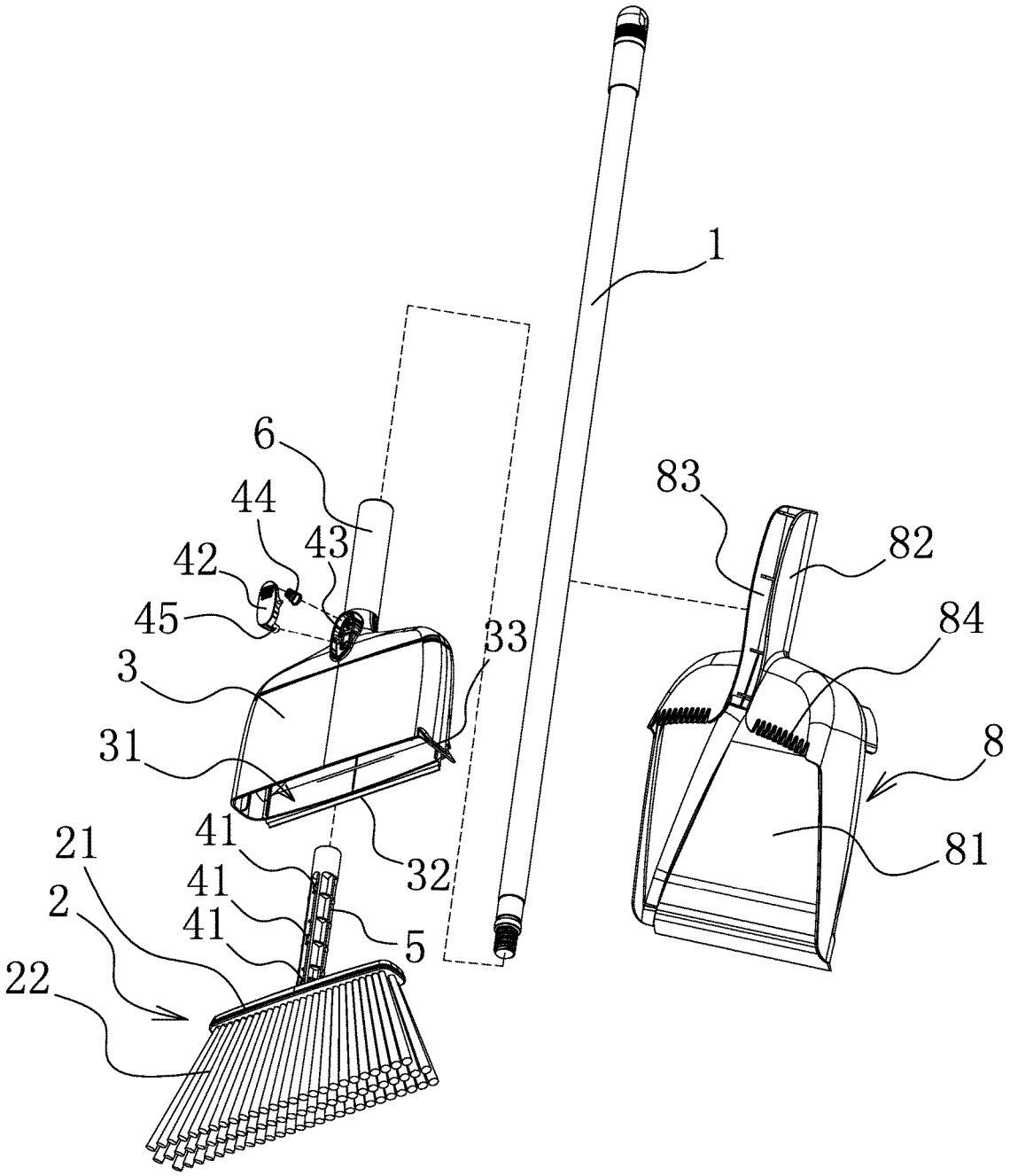
FIG. 2 is an exploded view of Embodiment 1 of the present utility model.

1: broom pole;
2: broom head;
21: base;
22: bristles;
3: broom head housing;
31: opening;
32: first scraper;
33: second scraper;
4: contractible positioning mechanism;
41: gear positioning holes;
42: button plate;
43: switch mounting groove;
44: spring;
45: positioning column;
5: connecting column;
6: tube;
7: connecting sleeve;
8: bucket;
81: bucket body;
82: handle;
83: slot; and
84: toothed plates.

DETAILED DESCRIPTION OF THE UTILITY MODEL

The present utility model will be further described as below in details with reference to the drawings and specific implementations.

Embodiment 1

As shown in FIGS. 1-5, a multifunctional broom is provided, including a broom pole 1 and a broom head 2 disposed at one end of the broom pole 1. A broom head housing 3 axially movably disposed on the broom pole 1 is provided in the periphery of the broom head 2. An opening 31 for allowing the lower end of the broom head 2 to extend from the broom head housing 3 is formed at the lower end of the broom head housing 3. A contractible positioning mechanism 4 for enabling the broom head housing 3 to be positioned on the broom pole 1, when the length of the lower end of the broom head 2 extending from the broom head housing 3 is adjusted to a desired length, is provided between the broom pole 1 and the broom head housing 1. When the broom head housing 3 is axially moved relative to the broom pole 1, by controlling the length of the broom head 2 extending from the broom head housing 3 by the contractible positioning mechanism 4 and allowing the broom head 2 to be fixed relative to the broom head housing 3, the extension length of the brush on the broom head 2 may be realized, so that broom has various use states.

Specifically, in this embodiment, the broom head 2 includes a base 21 and bristles 22 provided on the base 21. The base 21 is fixedly connected to the broom pole 1. A lower end of the bristles 22 is able to axially move upward relative to the broom pole 1 along with the broom head housing 2 and thus extend from the opening 31, and the length of the lower end of the bristles 22 extending from the opening 31 is controlled by the contractible positioning mechanism 4. Here, the base 21, the broom pole 1 and the bristles 22 are fixedly connected to each other, and the length of the exposed bristles 22 is controlled by axially moving the broom head housing 3 relative to the broom pole 1. The contractible positioning mechanism 4 is a gear-type positioning mechanism or an infinite-adjustment positioning mechanism. Of course, other contractible positioning mechanisms enabling the broom head housing 3 to be posited on the broom pole 1 are also suitable for this embodiment.

The contractible positioning mechanism specifically includes a plurality of gear positioning holes 41 that are axially distributed along the broom pole 1 at intervals and located on a same straight line, and a switching mechanism capable of being fitted with the gear positioning holes 41 to realize the positioning of the broom head housing 3 on the broom pole 1 is provided on the broom head housing 3. By fitting the switching mechanism with the plurality of gear positioning holes 41, the positioning of the broom head housing 3 on the broom pole 1 is realized. Preferably, in this embodiment, the switching mechanism includes a button plate 42, a switch mounting groove 43 and a spring 44. The switch mounting groove 43 is located on an outer side of the broom head housing 3, and the middle portion of the button plate 43 is rotatably connected to the broom head housing 3. A positioning column 45, which can be inserted into the positioning holes 41, is provided at one end of the button plate 42. The spring 44 is provided between the other end of the button plate 42 and the broom head housing 3. One end of the spring 44 acts on the button plate 42, while the other end thereof acts on the broom head housing 3. When in use, the button plate 42 drives the positioning column 45 to be inserted into a gear positioning hole 41 under the action of the spring 44 so as to realize the positioning of the broom head housing 3 on the broom pole 1. When one end of the button plate 42 is pressed down to overcome the acting force of the spring 4, the button plate 42 swings, and the positioning column 45 is disconnected from the gear positioning hole 41 so as to release the positioning.

Figure 3:
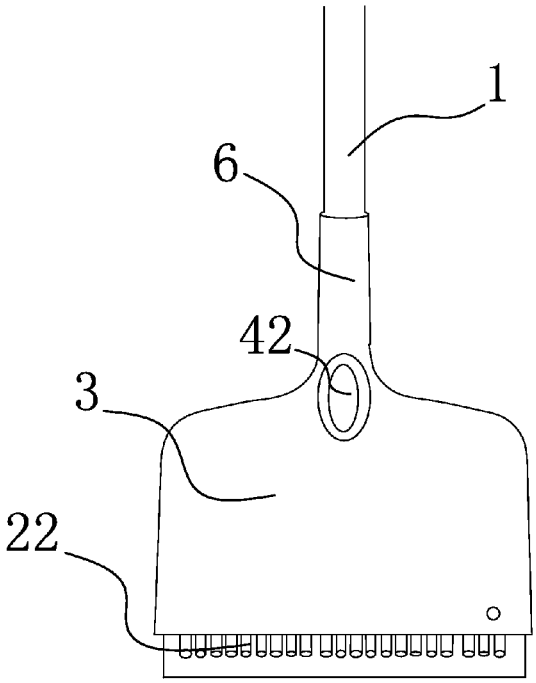
FIG. 3 is a structural diagram of Embodiment 1 of the present utility model, when an uppermost gear positioning hole is fitted with a switching mechanism.
Figure 4:
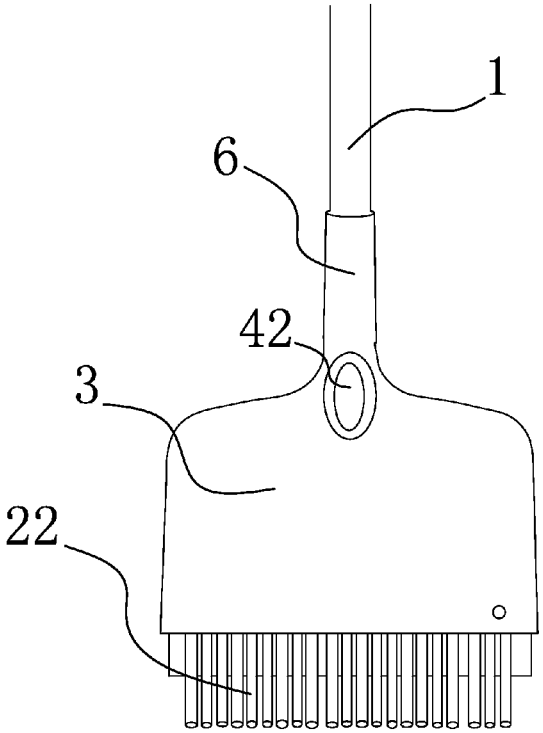
FIG. 4 is a structural diagram of Embodiment 1 of the present utility model, when a middle gear positioning hole is fitted with a switching mechanism.
Figure 5:
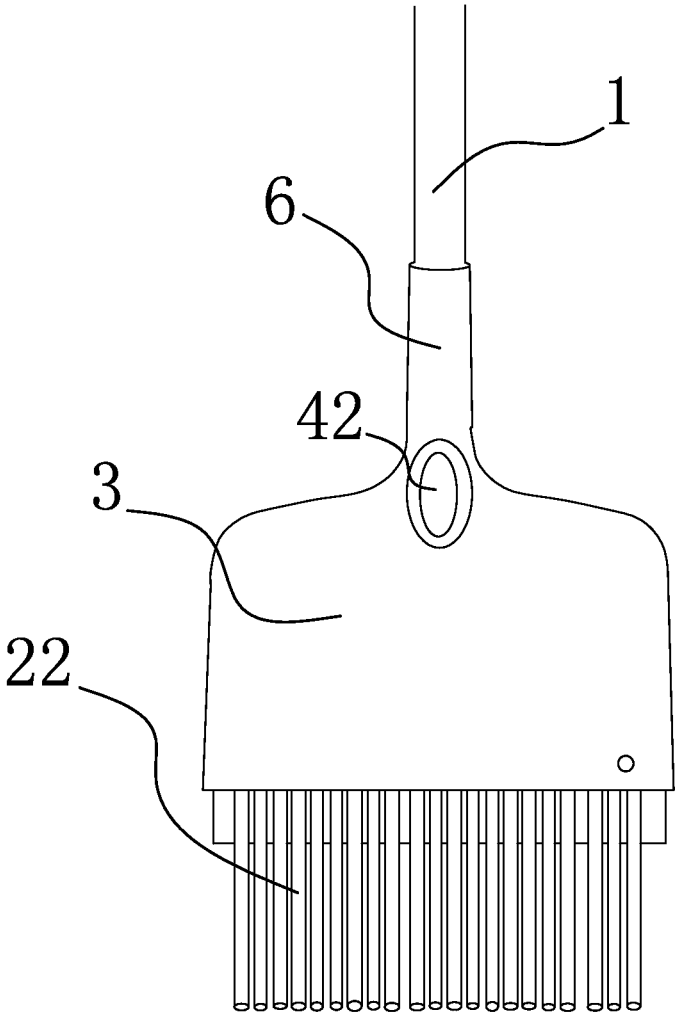
FIG. 5 is a structural diagram of Embodiment 1 of the present utility model, when a lowermost gear positioning hole is fitted with a switching mechanism.

Further, in this embodiment, the middle portion of the base 21 is connected with a connecting column 5 which is connected to the broom pole 1 for example in a thread manner. The upper end of the broom head housing 3 has a tube 6 communicated to the inside of the broom head housing 3, and the connecting column 5 and the lower end of the broom pole 1 are penetrated into the tube 6, so that the tube 6 may protect the connection of the connecting column 5 and the broom pole 1. There are three gear positioning holes 41 all provided on the connecting column 5. When the uppermost gear positioning hole 41 is fitted with the switching mechanism, the lower end of the bristles 22 is located in the broom head housing 3; when the middle gear positioning hole 41 is fitted with the switching mechanism, a portion of the lower end of the bristles 22 exposed from the broom head housing 3 serves as a brush; and when the lowermost gear positioning hole 41 is fitted with the switching mechanism, a portion of the lower end of the bristles 22 exposed from the broom head housing 3 functions as cleaning. In other words, the broom has three gears, i.e., upper, middle and lower gears. When the uppermost gear positioning hole 41 is fitted with the switching mechanism, as shown in FIG. 3, the bristles 22 may be hidden in the broom head housing 3, and the outer side of the end portion of the broom head housing 3 may scrape off dirt at a position to be cleaned, wherein, at a side portion of the lower end of broom head housing 3, provided is any one or a combination of a first scraper 32 extending along a length direction of the opening 31 and a second scraper 33 extending along a width direction of the opening 31. Thus, the use effect when the bristles 22 are hidden in the broom head housing and the broom serves as a scraper is improved. When the middle gear positioning hole 41 is fitted with the switching mechanism, as shown in FIG. 4, a portion of the bristles 22 is exposed, and the exposed portion may serve as a brush due to short length and high hardness. When the lowermost gear positioning hole 41 is fitted with the switching mechanism, as shown in FIG. 5, a portion of the lower end of the bristles 22 exposed from the broom head housing 3 functions as cleaning.

In addition, in this embodiment, the multifunctional broom further includes a bucket 8. The bucket 8 includes a bucket body 81 having a shape fitted with the broom head housing 3 and a handle 82 provided at the upper end of the bucket body 81. The handle 82 has a slot 83 which axially extends along the handle 82 and is able to be buckled on the broom pole 1. Two shoulders of the bucket 81 are provided with toothed plates 84, respectively. Here, the broom and the bucket are used cooperatively, the bucket may be used for gathering the rubbish cleaned by the broom, and the toothed plates on the bucket may clean dirt on the bristles.

The principle of this embodiment is as follows: when in use, the broom head housing 3 is pushed to axially move on the broom pole 1, and the button plate 42 drives the positioning column 45 to be inserted into a gear positioning hole 41 under the action of the spring 44 so as to realize the positioning of the broom head housing 3 on the broom pole 1. The broom has three gears, i.e., upper, middle and lower gears. When the positioning column 45 is inserted into the uppermost gear positioning hole 41, the bristles 22 may be hidden in the broom head housing 3, and the outer side of the end portion of the broom head housing 3 may scrape off dirt at a position to be cleaned; when the positioning column 45 is inserted into the middle gear positioning hole 41, a portion of the bristles 22 is exposed, and the exposed portion may serve as a brush due to short length and high hardness; and when the positioning column 45 is inserted into the lowermost gear positioning hole 41, a portion of the lower end of the bristles 22 exposed from the broom head housing 3 functions as cleaning. Furthermore, it is required to shift a gear, one end of the button plate 42 is pressed down to overcome the acting force of the spring 4, then the button plate 42 swings, and the positioning column 45 is disconnected from the gear positioning hole 41 so as to release the positioning Embodiment 2

Figure 6:
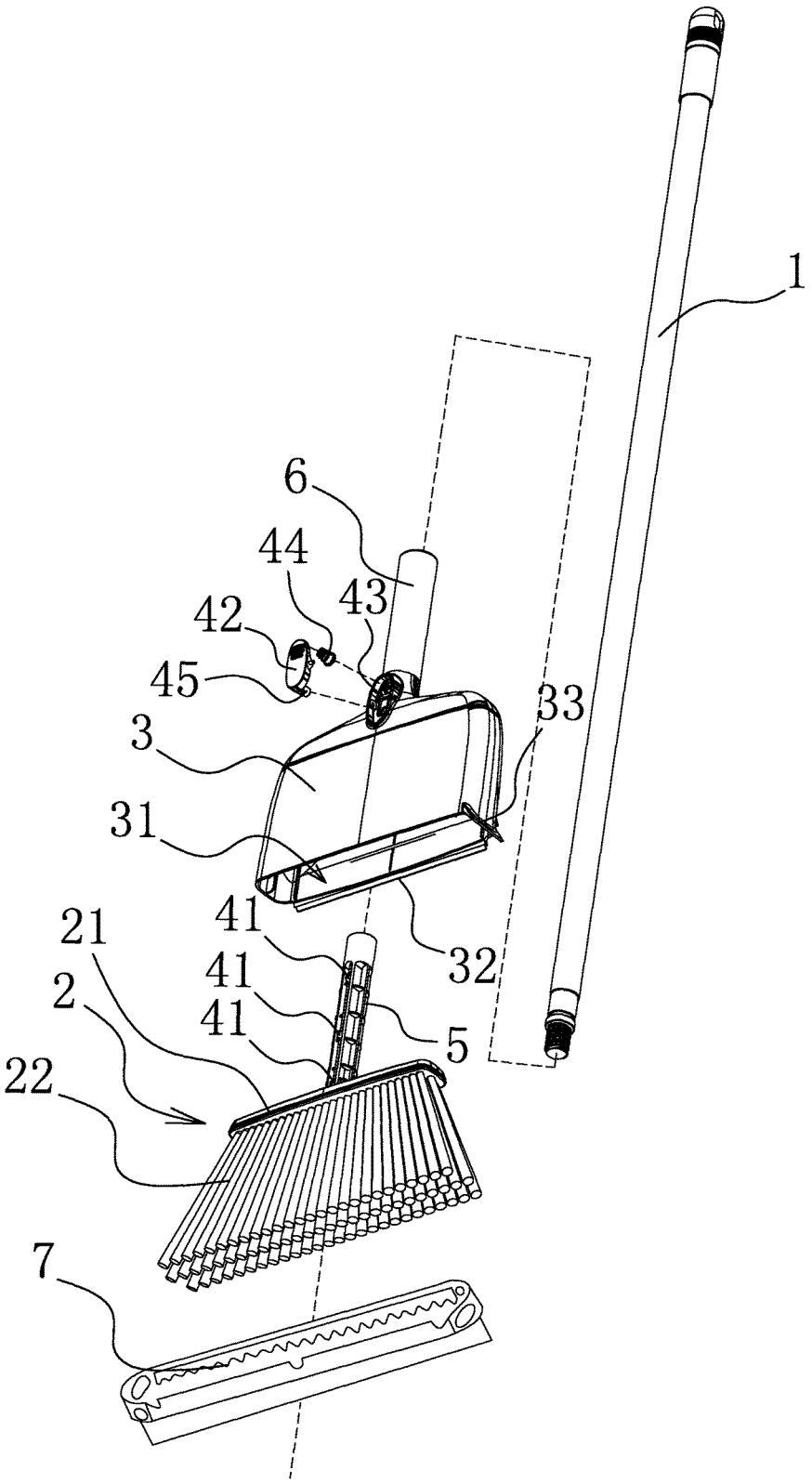

As shown in FIG. 6, the structure and principle of this embodiment are basically the same as Embodiment 1, expect for a difference that a connecting sleeve 7 is provided in the opening 31 of the broom head housing 1, and the bristles 22 may pass through a grate provided in the connecting sleeve 7. Thus, when the broom head housing 3 is retracted, the grate may clean dirt such as hairs on the bristles 22.

The specific embodiments described herein are merely for illustrating the spirit of the present utility model. Those skilled in the art to which the present utility model pertains may make various modifications or supplements or similar replacements to the specific implementations described herein without departing from the spirit of the present utility model or the scope determined by the appended claims.

Although the terms, such as the broom pole 1, the broom head 2, the base 21, the bristles 22, the broom head housing 3, the opening 31, the first scraper 32, the second scraper 33, the contractible positioning mechanism 4, the gear positioning holes 41, the button plate 42, the switch mounting groove 43, the spring 44, the positioning column 45, the connecting column 5, the tube 6, the connecting sleeve 7, the bucket 8, the bucket body 81, the handle 82, the slot 83 and the toothed plates 84, are frequently used herein, the possibility of using other terms is not exclusive. The use of these terms is merely for the convenience of description and explanation of the essence of the present utility model, and the interpretation of the terms into any additional limitation shall conflict with the spirit of the present utility model.

The invention claimed is:

1. A multifunctional broom, comprising:

a broom pole;

a broom head disposed at one end of the broom pole;

a broom head housing for receiving the broom head that is axially movably disposed on the broom pole;

an opening for allowing the lower end of the broom head to extend from the broom head housing formed at the lower end of the broom head housing, and a contractible positioning mechanism for enabling the broom head housing to be positioned on the broom pole, when the length of the lower end of the broom head extending from the broom head housing is adjusted to a desired length, that is configured to movably attach the broom head housing to the broom pole, wherein the broom head comprises a base and bristles provided on the base, the base being fixedly connected to the broom pole, a lower end of the bristles being able to axially move upward relative to the broom pole along with the broom head housing and thus extend from the opening, the length of the lower end of the bristles extending from the opening being controlled by the contractible positioning mechanism, wherein the contractible positioning mechanism comprises a plurality of gear positioning holes that are axially distributed along the broom pole at intervals and located on a same straight line, wherein a switching mechanism capable of being fitted with the gear positioning holes to realize the positioning of the broom head housing on the broom pole is provided on the broom head housing, wherein the middle portion of the base is connected with a connecting column which is in threaded connection to the broom pole, wherein the upper end of the broom head housing has a tube communicated to the inside of the broom head housing, wherein the connecting column and the lower end of the broom pole are penetrated into the tube, wherein three gear positioning holes are provided on the connecting column, wherein when the uppermost gear positioning hole is fitted with the switching mechanism, the lower end of the bristles is located in the broom head housing, wherein when the middle gear positioning hole is fitted with the switching mechanism, a portion of the lower end of the bristles exposed from the broom head housing serves as a brush, wherein when the lowermost gear positioning hole is fitted with the switching mechanism, a portion of the lower end of the bristles exposed from the broom head housing functions as cleaning, wherein the multifunctional broom further comprises a bucket, the bucket comprising a bucket body having a shape fitted with the broom head housing and a handle provided at the upper end of the bucket body, the handle having a slot which axially extends along the handle and is able to be buckled on the broom pole, and two shoulders of the bucket being provided with toothed plates, respectively, wherein the slot of the handle of the bucket and the handle of the bucket have a same length in an axial direction wherein the switching mechanism comprises a button plate, a switch mounting groove and a spring, the switch mounting groove being located on an outer side of the broom head housing, the middle portion of the button plate being rotatably connected with the broom head housing, a positioning column which can be inserted into the positioning holes being provided at one end of the button plate, the spring being provided between the other end of the button plate and the broom head housing, one end of the spring acting on the button plate while the other end thereof acting on the broom head housing, wherein a connecting sleeve is provided in the opening of the broom head housing, and the bristles can pass through a grate provided in the connecting sleeve, and wherein a first scraper extending along a direction of the length of the opening and a second scraper extending along a direction of the width of the opening are provided at a side portion of the lower end of broom head housing.

2. The multifunctional broom according to claim 1, wherein the toothed plates respectively extend from the slot of the handle in a direction away from the slot and cover a portion of the bucket body, and teeth of the toothed plates are arranged in a direction perpendicular to an axial direction of the handle.

* * * * *